United States Patent [19]

Sujdak

[11] 4,185,071

[45] Jan. 22, 1980

[54] ETHYLENE POLYAMINES AS COLD-END ADDITIVES

[75] Inventor: Richard J. Sujdak, Morrisville, Pa.

[73] Assignee: Betz Laboratories, Inc., Trevose, Pa.

[21] Appl. No.: 950,960

[22] Filed: Oct. 13, 1978

[51] Int. Cl.[2] ..... C23F 11/00; C23F 11/02

[52] U.S. Cl. ..... 422/9; 110/343; 110/345; 252/392; 423/242; 423/243

[58] Field of Search ..... 422/9; 423/242 R, 243, 423/244 R; 110/343, 345; 242/392

[56] References Cited

U.S. PATENT DOCUMENTS

| | | | |
|---|---|---|---|
| 2,106,446 | 1/1938 | Baer et al. | 423/243 X |
| 2,155,853 | 4/1939 | Anthony | 423/243 X |
| 2,972,861 | 2/1961 | Davies | 422/9 X |
| 3,343,908 | 9/1967 | Wickert | 423/244 |
| 3,547,583 | 12/1970 | Wilson | 423/242 |
| 3,709,977 | 1/1973 | Villiers-Fisher | 423/244 |
| 3,720,754 | 3/1973 | Wilson | 423/244 |
| 3,809,745 | 5/1974 | Wilson | 423/244 |
| 3,856,921 | 12/1974 | Shrier et al. | 423/243 X |
| 3,873,673 | 3/1975 | Teague et al. | 423/243 |
| 3,886,261 | 5/1975 | Libutti | 423/244 |
| 3,904,735 | 9/1975 | Atwood et al. | 423/243 |
| 3,932,588 | 1/1976 | Libutti et al. | 423/244 |
| 3,961,018 | 6/1976 | Williamson | 423/243 X |
| 3,962,404 | 6/1976 | Giammarco et al. | 423/243 X |

FOREIGN PATENT DOCUMENTS

| | | | |
|---|---|---|---|
| 872984 | 7/1961 | United Kingdom | 423/244 |
| 1305750 | 2/1973 | United Kingdom | 423/244 |

OTHER PUBLICATIONS

Bienstock et al., "Process Development in Removing Sulfur Dioxide from Hot Flow Gases," Report No. 5735, Bureau of Mines, pp. 8–17.

Gundry et al., "The Use of Ammonia for Reducing Air-Heater Corrosion at Bankside Generating Station, C.E.G.B.", *Combustion*, vol. 36, 10/64, pp. 39–47.

*Primary Examiner*—Barry S. Richman

*Attorney, Agent, or Firm*—Alexander D. Ricci; Steven H. Markowitz

[57] ABSTRACT

A method of reducing the amount of corrosion due to sulfuric acid on metal parts at the cold-end of a combustion system and in contact with combustion gases derived from the combustion of sulfur-containing fuel, said method comprising adding to the combustion gases an effective amount for the purpose of an ethylene polyamine additive.

9 Claims, 2 Drawing Figures

ETHYLENE POLYAMINES AS COLD-END ADDITIVES

TECHNICAL FIELD

Figure 2:
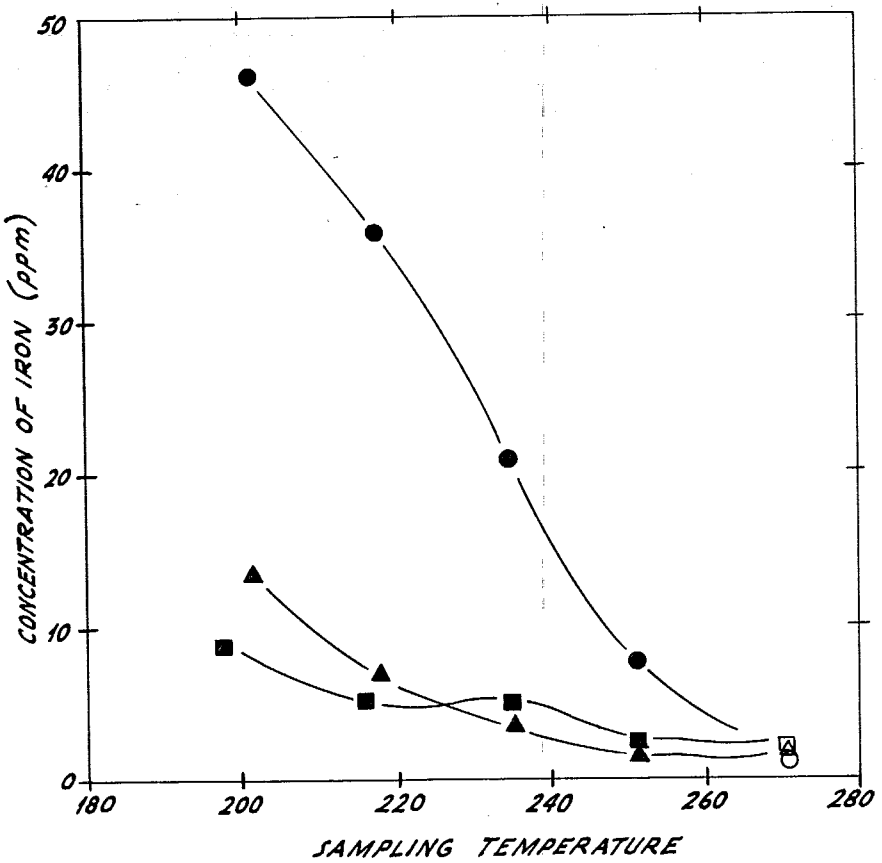

As is well known to boiler operators, sulfur-containing fuels present problems not only from a pollutional point of view, but also with respect to the life and operability of metallic equipment and parts which are in contact with the flue gases containing the sulfur by-products of combustion. While the problem will be discussed herein with respect to boilers, it should be understood that both the problem and its solution could apply to other systems, such as process furnaces.

Upon combustion, the sulfur in the fuel is converted to sulfur dioxide and sulfur trioxide. In the flue gas, sulfur trioxide and water vapor are in equilibrium with sulfuric acid. Below about 450° F., essentially all of the $SO_3$ is converted to $H_2SO_4$ for typical flue gas compositions of oil fired boilers. The resulting sulfuric acid condenses upon metal surfaces which are at temperatures below the acid dewpoint. Corrosion results from the attack of the condensed sulfuric acid on the metals.

As can be appreciated, the greater the sulfur content of the fuel, the more sulfuric acid will likely be produced. This is particularly the case in industrial and utility operations where low grade oils are used for combustion purposes.

The basic area to which the present invention is directed is often referred to in the industry as the "cold-end" of a boiler. This area is generally the path in the boiler system that the combustion gases follow after the gases have, in fact, performed their primary service of producing and/or superheating steam.

In larger boiler systems, the last stages through which the hot combustion gases flow include the economizer, the air-heater, the collection equipment or electrostatic precipitator, and then the stack through which the gases are discharged.

DESCRIPTION OF THE INVENTION

The present invention is drawn to the present inventor's discovery of ethylene polyamines as cold-end additives. It was determined that if an ethylene polyamine (or mixture of ethylene polyamines) is fed, preferably in droplet form, to the moving combustion gases upstream of the cold-end surfaces to be treated and preferably at a point where the gases are undergoing turbulence, the chemical will travel along with the gases as vapor and/or liquid droplets and deposit on the downstream cold-end surfaces. It is understood that any reference to ethylene polyamines is intended to include mixtures of such compounds. While a point of turbulence of the combustion gases is a preferred feed point for the additive, a point of laminar gas flow could also be used, provided that suitable mechanical means are utilized for proper treatment distribution. For example, an increased number of spray nozzles may be suitably arranged within a gas flow conduit to provide adequate treatment distribution.

The term "ethylene polyamines" is intended to include hydrocarbon chains consisting of at least two amino groups connected by ethylene group(s). For example, the lowest homolog in the series would be ethylene diamine having the following structure:

$$NH_2—CH_2—CH_2—NH_2.$$

Also for example, a higher homolog in the series would be tetraethylenepentamine having the structure:

$$HN—(CH_2—CH_2—NH—CH_2—CH_2—NH_2)_2.$$

In terms of a general formula, ethylene polyamines according to the present invention could best be described by the following:

$$H_2N—CH_2(—CH_2—NH—CH_2—)_nCH_2—NH_2 \quad (I)$$

Since ethylene diamine is the lowest homolog in the series, the lower limit for n is 0. It is the present inventor's opinion that there is no upper limit for n in Formula I other than that based on the commercial availability of the material. In any event, the highest homolog tested was poly(ethylenimine) having the formula:

$$\text{-}(CH_2—CH_2—NH)\text{-}_n,$$

which material had an average molecular weight of about 50,000 to 100,000; and, therefore, n was about 1000 to 2500. While all of the compounds tested had ethylene groups connecting the amino groups, it is believed that other lower alkyl interconnecting groups could be used. For example, it is the present inventor's belief that trimethylene or tetramethylene groups are suitable equivalents for the ethylene group. However, preliminary testing has indicated that hexamethylene interconnecting groups are unsuitable for the purpose.

Except for high molecular weight species which are highly viscous, the additive can be fed neat; however, an aqueous solution of additive is preferred. Due to its high solubility in water, the concentration of actives in the aqueous solution could, of course, vary over a wide range, depending only on economics of handling and shipment and the characteristics of the feed system. For example, the additive could be shipped neat and diluted at the point of application. If dilution at the point of application is undesirable or not possible, then the additive would be sent pre-diluted. Due to costs of shipment and handling, it would be undesirable to ship very dilute aqueous solutions. The preferred lower concentration limit would be about 5% actives on a weight basis, with the most preferred lower limit being about 15%. The upper concentration limit could approach 100%; however, about 60% represents the preferred upper limit.

There are numerous well known methods available to the artisan for feeding the additive to the combustion gases. For example, the additive could be sprayed at a point of turbulence of the combustion gases upstream of the problem area using any well known atomizing spray nozzle(s). However, precautions should be taken to ensure that the problem areas will encounter treated flue gas. For instance, if the problem area is located centrally within a flow conduit for the combustion gases, the spray should be directed into the conduit in such a manner as to ensure that a sufficient amount of additive is present in the center of the conduit upon reaching the location of the problem area. Thus, an axially located spray nozzle which sprays the additive in the same direction that the combustion gases flow would be recommended for such a centrally located problem area.

The feedrate for the additive could vary over a wide range depending on the nature and severity of the problem to be solved. The lower limit would depend on the sulfur content of the fuel oil and the particular species of ethylene polyamine additive being used. For example, for a fuel oil containing 1% sulfur, 0.05 mole of triethylenetetramine per barrel (m/bbl) of fuel oil consumed has proven to be efficacious; while only 0.0004 mole of high molecular weight poly(ethylenimine) per barrel of fuel oil consumed (m/bbl) was required to do the job. It is the inventor's opinion that the upper limit would depend only on economic considerations. Accordingly, for fuel oil containing 1% sulfur (weight basis), the upper limit would be considered to be about 1 m/bbl based on economic considerations, with about 0.5 m/bbl representing a preferred upper limit.

The temperature of the combustion gases at the point of feed is typically about 400° F. to 750° F., but this range could widen depending on the gas temperature at the furnace exit.

EXAMPLES

In order to assess the efficacy of the inventive materials, various tests were conducted using a D-type boiler manufactured by Keeler. The boiler is rated at 26,000 pounds of steam per hour and is normally operated at 200 psig pressure.

Since the primary function of a cold-end additive is to eliminate or reduce corrosion caused by the condensation of sulfuric acid, techniques that measure corrosion were expected to yield the most direct information about product performance. Accordingly, the well known method of quantifying the reduction in corrosion of a stainless steel air-cooled probe was used for determining efficacy as cold-end additives. The probe used was similar to a standard British Central Electricity Research Laboratories (CERL) acid deposition probe. The construction and operation of this probe are well known in the art as evidenced by an article entitled "An Air-Cooled Probe for Measuring Acid Deposition in Boiler Flue Gases" by P. A. Alexander, R. S. Fielder, P. J. Jackson and E. Raask, page 31, Volume 38, *Journal of the Institute of Fuel;* which article is hereby incorporated by reference to indicate the state of the art. Flue gas constituents were allowed to condense on the probe for 45 minutes. The probe was then immediately washed with doubly distilled water and analyzed for iron and sulfate. Corrosion was measured by analyzing the probe washings for water soluble iron, which is also a well known technique.

Since a cold-end additive should be capable of travelling along with the combustion gases and depositing on the downstream cold-end surfaces to be treated, the various additives tested were sprayed, using a standard atomizing spray nozzle arrangement, into the combustion gases at a point of turbulence located upstream of the air-cooled probe.

Immediately before base loading, the boiler was taken through a soot blowing cycle, and the burner tip was manually cleaned. The boiler was then based loaded for one hour prior to initiating testing. Fuel oil of precisely the same composition was fired over a given period of time to ensure reproducibility of baseline data throughout the period. However, for critical testing, daily determination of baseline data is recommended. The boiler was fired with number 6 grade fuel oil containing 1% sulfur (by weight). The oil was preheated to 170° F. and atomized with steam. Combustion air was at ambient temperature. Flue gas temperatures at the sampling point ranged from 440° F. to 480° F. The sulfuric acid dewpoint using either a Land Depoint Meter or a corrosion probe was typically 262° F. Using a Research Appliance Corporation sampling device, the concentration of $SO_3$ was determined to be about 7 parts per million parts of combustion gas (ppm, on volume basis).

The materials tested were ethylene diamine, available from Union Carbide; diethylenetriamine, obtained from Fisher; triethylenetetramine, obtained from Aldrich; tetraethylenepentamine, obtained from Aldrich; poly(ethylenimine), also obtained from Aldrich; and ethylamine, obtained from Pennwalt.

The results of a series of tests are reported below in Table 1, wherein a different test number indicates that tests were conducted on a different day. The % $O_2$ reported is the oxygen content of the combustion gas on a volume basis. The additive feedrates are reported as mole(s) of feed per barrel of fuel oil consumed (mole/bbl), and the probe corrosion results are reported as % reduction in iron content of the probe washings for the indicated temperatures as compared to base condition corrosion.

TABLE 1

| Test | Additive | % $O_2$ | Steam Load (pph × $10^{+3}$) | Additive Feedrate (mole/bbl) | % Reduction in (Fe) 190° F. | 200° F. | 210° F. | 230° F. | 250° F. |
|---|---|---|---|---|---|---|---|---|---|
| 1 | diethylenetriamine | 5.3 | 13.0 | .43 | 89 | | 96 | 93 | 56 |
| 2 | diethylenetriamine | 6 | 13.5–14 | .13 | 60 | | 52 | 73 | 0 |
| | ethylamine | 6 | 13.5–14 | .12 | 0 | | Very Corrosive | | |
| 3 | diethylenetriamine | 6.0 | 14.5–15.5 | .31 | 88 | | 87 | 88 | 75 |
| | triethylenetetramine | 6.0 | 14.5–15.5 | .34 | 93 | | 96 | 94 | 75 |
| 4 | triethylenetetramine | 6.0 | 15.5–16.5 | .054 | | 21 | 42 | 50 | 46 |
| 5 | diethylenetriamine | 6.0 | 14.5–15.5 | .088 | | | 0 | 27 | 0 |
| 6 | triethylenetetramine | 6.0 | 14.5–15.5 | .066 | | 33 | 49 | 54 | 40 |
| 7 | triethylenetetramine | 6.0 | 13–14 | .06 | 25 | | 42 | 40 | 75 |
| 8 | triethylenetetramine | 6.0 | 14–15 | .081 | | 40 | 53 | 57 | 43 |
| 9 | triethylenetetramine | 6.0 | 14–15 | .09 | | 40 | 41 | 49 | 66 |
| 10 | diethylenetriamine | 6.0–6.2 | 15 | .12 | | 27 | 45 | 31 | 0 |
| | triethylenetetramine | 6.0–6.2 | 15 | .084 | | 0 | 21 | 31 | 0 |
| | tetraethylenepentamine | 6.0–6.2 | 15 | .055 | | 13 | 52 | 48 | 0 |
| 11 | triethylenetetramine | 6.0 | 15.5–17 | .09 | | 46 | 78 | 49 | 77 |

As can be seen from Table 1, the ethylene polyamines tested were quite effective in reducing the corrosion of the test probe. On the other hand, the ethylamine tested, which is known as a neutralizing agent for $SO_x$ gases in wet scrubbers, was ineffective. It was, accordingly, the present inventor's conclusion that the ethylene polyamines are effective cold-end additives while ethylamine is not.

The accompanying drawings are graphic representations of test results comparing various ethylene polyamines, as indicated below, to base conditions.

Figure 1:
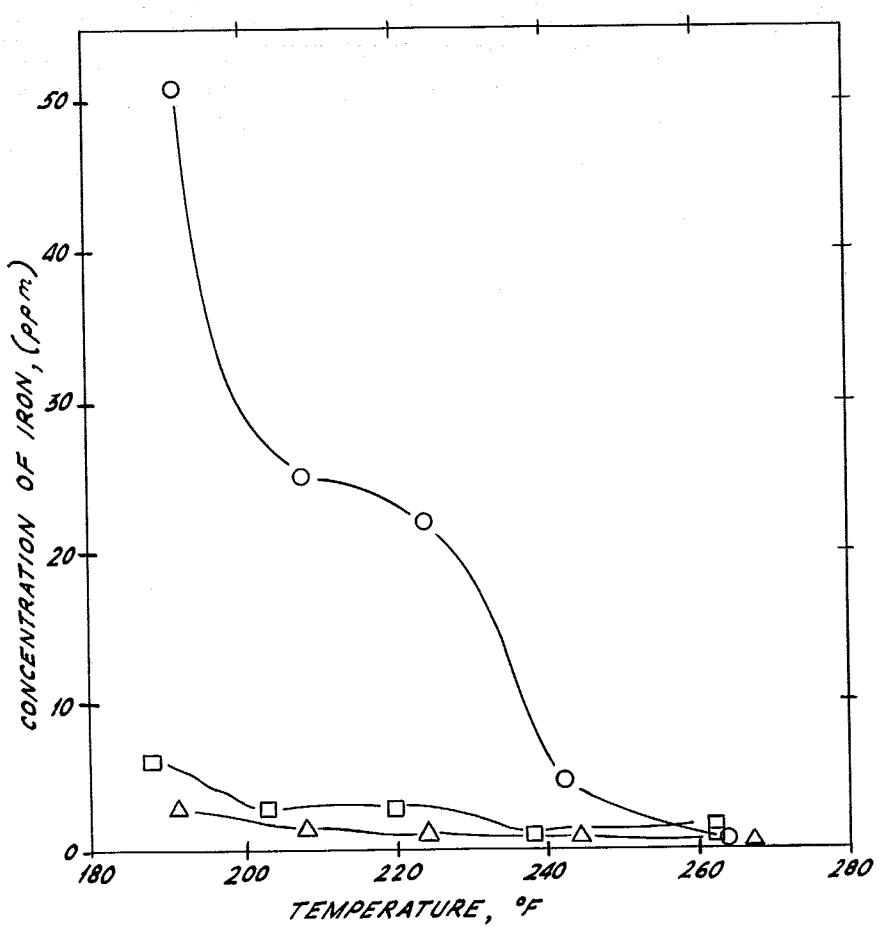

In FIG. 1 are reported the results of tests comparing diethylenetriamine and triethylenetetramine to base conditions. As can be seen from the figure, the results are graphically reported as a plot of concentration of iron in the probe washings, in ppm, against the sampling temperature in °F. The results for base conditions are represented by circles, the results for diethylenetriamine are represented by squares, and the results for triethylenetetramine are represented by triangles. During the test period, the boiler was operated at approximately 14,000 pounds of steam per hour with oxygen being 6% of the flue gas. The additives were both fed at a rate of 0.33 mole per barrel of oil consumed (0.33 m/bbl).

As can be seen from FIG. 1, the ethylene polyamines did indeed significantly reduce corrosion as compared to base conditions.

In FIG. 2 are reported the results of tests comparing ethylene diamine and poly(ethylenimine) to base conditions. The poly(ethylenimine) had a molecular weight average of about 50,000 to 100,000 such that n in Formula I above would be about 1000 to 2500. As can be seen from the figure, the results are graphically reported as a plot of concentration of iron in the probe washings, in ppm, against the sampling temperature °F. The results for base conditions are represented by solid circles, the results for ethylene diamine are represented by solid squares, and the results for poly(ethylenemine) are represented by solid triangles. During the test period, the boiler was operated at approximately 12,000–13,000 pounds of steam per hour with oxygen being about 6% of the flue gas. The ethylene diamine was fed at a rate of 0.38 mole/bbl of fuel oil consumed, and the poly(ethylenimine) was fed at a rate of 36.3 milliliters per barrel of oil consumed. Due to the uncertainty of the exact molecular weight of the poly(ethylenimine), no exact molar feedrate was calculable. However, based on the noted molecular weight range for the material and a density of approximately 1 gram per milliliter, the feedrate was about 0.0004 to 0.0007 mole/bbl.

As can be seen from FIG. 2, the ethylene polyamines did indeed significantly reduce corrosion as compared to base conditions.

In addition to efficacy as a cold-end additive, preliminary evidence has indicated that reduction of fouling on cold-end surfaces may be an added benefit of using the described materials.

Having thus described my invention, I claim:

1. A method of reducing the amount of sulfuric acid corrosion of metal parts at the cold-end of a combustion system and in contact with combustion gases derived from the combustion of sulfur-containing fuel, which combustion gases flow along a path at the cold end of the combustion system from a first zone of relative turbulence to a second zone at which said metal parts are located, said method comprising:

adding to the combustion gases at the cold end of the combustion system and at the zone of turbulence an effective amount for the purpose of an additive comprising at least one member of the group consisting of ethylene polyamines which include a hydrocarbon chain consisting of at least two amino groups which are ethylene-interconnected such that said additive will travel along with said gases as vapor and/or liquid droplets, from said zone of turbulence to said second zone.

2. The method of claim 1, wherein said ethylene polyamine is added in droplet form.

3. The method of claim 1, wherein said ethylene polyamine is added as an aqueous solution.

4. The method of claim 3, wherein said aqueous solution is sprayed into the combustion gases.

5. The method of claim 1, wherein the combustion system is a steam generating system and the fuel is sulfur-containing oil.

6. The method of claim 5, wherein said ethylene polyamine is added in droplet form.

7. The method of claim 5, wherein said ethylene polyamine is added as an aqueous solution.

8. The method of claim 7, wherein said aqueous solution is sprayed into the combustion gases.

9. The method of claim 8, wherein said ethylene polyamine is an aqueous solution which is added to said combustion gases at the rate of about from 0.0001 to 1.0 mole per barrel of fuel consumed.

* * * * *